US006186622B1

(12) United States Patent
Garcia et al.

(10) Patent No.: US 6,186,622 B1
(45) Date of Patent: Feb. 13, 2001

(54) LOW EXPANSION SNOUT INSERT FOR INKJET PRINT CARTRIDGE

(75) Inventors: André Garcia, Poway; Steven W. Steinfield, San Diego, both of CA (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 09/320,411

(22) Filed: May 26, 1999

(51) Int. Cl.[7] ..... B41J 2/175
(52) U.S. Cl. ..... 347/86
(58) Field of Search ..... 347/85, 86, 87, 347/18, 63, 40

(56) References Cited

U.S. PATENT DOCUMENTS 5,506,608 4/1996 Marler et al. ..... 347/18
5,537,133 7/1996 Marler et al. ..... 347/18
5,648,806 7/1997 Steinfield et al. ..... 347/87

*Primary Examiner*—N. Le
*Assistant Examiner*—Michael Nghiem

(57) ABSTRACT

Described herein is a snout insert, referred to as an exapander, which is pressed fit into the snout of a plastic inkjet print cartridge. The expander has a low coefficient of thermal expansion (CTE) and a high tensile modulus relative to the print cartridge body. The expander reduces the CTE of the snout to be closer to, or less than, the CTE of the nozzle member, such as a TAB head assembly, to reduce or prevent warpage of the nozzle member due to thermal cycling of the print cartridge during the manufacturing process. The nozzle member is then fixed to the snout. The expander is designed for a precise fit into the snout and, in one embodiment, includes machinable datums to ensure a tight fit. In one embodiment, the expander is inserted through the ink reservoir area in the print cartridge body and pushed into the snout.

20 Claims, 3 Drawing Sheets

LOW EXPANSION SNOUT INSERT FOR INKJET PRINT CARTRIDGE

FIELD OF THE INVENTION

This invention relates to inkjet printers and, in particular, to an improvement in inkjet print cartridges.

BACKGROUND

A complete description of an inkjet printer and an inkjet print cartridge is provided in U.S. Pat. No. 5,648,806, entitled "Stable Substrate Structure For A Wide Swath Nozzle Array In A High Resolution Inkjet Printer," by Steven Steinfield et al., assigned to the present assignee and incorporated herein by reference. In inkjet print cartridges, poor print and image quality can be caused by misplaced ink drops, referred to as dot placement error or DPE. A main contributor to DPE is nozzle camber angle (NCA) caused by warpage of the tape automated bonded (TAB) head assembly. The TAB head assembly is a strip of flexible tape having nozzles formed therein and conductors formed on its back surface. A printhead substrate is secured to the back of the tape, and electrodes on the substrate are connected to the conductors on the tape. Contact pads on the cartridge receive electrical signals from the printer to eject ink drops from the nozzles.

The tape is secured to the snout of the print cartridge, and a fluid seal is made between the tape and the body of the print cartridge to allow ink to be fed around the edges of the substrate (or through a hole in the substrate) in order to reach ink ejection chambers formed on the top of the substrate. An ink ejection element in each ink ejection chamber is energized to eject a droplet of ink through an associated nozzle located over each ink ejection chamber.

A great deal of the flexible tape warpage may be created during the assembly process of securing the TAB head assembly to the print cartridge body.

Besides warpage affecting the nozzle angles, other undesireable effects caused by non-flatness of the TAB head assembly include die edge camber angle and macrodimple. These defects affect print quality, print speed, reliability, and serviceability. The table below summarizes the different components of the TAB head assembly flatness and their effects on customer perceivable attributes of the end product.

| The flatness component of | causes | affecting |
|---|---|---|
| NCA (Nozzle camber angle) | Drop trajectory variation (directionality) | print quality throughput: (# of printmode passes required) |
| DECA (Die edge camber angle) | Drop volume and drop velocity variation | print quality |
| DECA (Die edge camber angle) | Firing chamber refill frequency variation/reduction | print speed |
| Buckling (a.k.a. "macrodimple")/Warp (a.k.a. "ripple") | Wiping and capping margin reduction | serviceability |
| Buckling (a.k.a. "macrodimple")/Warp (a.k.a. "ripple") | Delamination stress, ink shorts robustness degradation | reliability |

FIG. 1 is a perspective view of an inkjet print cartridge 10, and FIG. 2 is a cross-sectional view of the printhead portion of the print cartridge of FIG. 1 along line 2—2. The components in the above table are identified in FIG. 2.

Generally, print cartridge 10 of FIG. 1 includes a print cartridge body 12, having a snout 14, which typically faces downwards toward a medium when the cartridge is installed in a scanning carriage. A printhead area 16 includes a nozzle member 18 having nozzles 20 formed therein. Nozzle member 18 may be formed of a flexible tape 22 (FIG. 2), as described above, or may be any other thin material.

Below nozzle member 18 is a printhead substrate 24 (FIG. 2), typically formed of silicon, having formed on it ink ejection elements, an ink ejection chamber surrounding each ink ejection element, and ink channels leading to the ink ejection chambers. Details are described in U.S. Pat. No. 5,648,806.

FIG. 2 is a cross-section along line 2—2 of FIG. 1 illustrating one type of printhead using a TAB head assembly. The plastic print cartridge body 12 supports the edges of the TAB head assembly. A substrate 24 is shown attached to the underside of the flexible tape 22. Ink flows from a reservoir in the print cartridge body 12 (or from an external reservoir) through an ink channel 25 in the print cartridge and into ink channels formed in a barrier layer on the surface of the substrate 24. The flexible tape 22 is sealed with respect to the print cartridge by an adhesive 26. Energizing signals are coupled to copper traces 28 formed on the back of the flexible tape 22 to energize the ink ejection elements to eject droplets of ink from the nozzles 20 formed in the flexible tape 22. A cover layer 30 prevents ink from contacting the copper traces 28.

As seen from FIG. 2, the flexible tape 22 is warped, which results in the effects previously described. One cause of the warpage is due to the thermal cycling of the print cartridge during manufacturing. The coefficients of thermal expansion of the print cartridge body 12 and the flexible tape 22 are not the same, causing the two components to expand to different extents when being heated, such as during heat curing of the adhesive 26. When these components are later cooled to room temperature, the fixing of the tape 22 to the print cartridge body 12 by the adhesive 26 causes compression of the tape 22 and distortion.

What is needed is a technique for improving the flatness of the TAB head assembly or any other nozzle member assembly.

SUMMARY

Described herein is a snout insert which is pressed fit into the snout of a plastic print cartridge. The snout insert (referred to herein as an expander) has a low coefficient of thermal expansion (CTE) and a high tensile modulus relative to the print cartridge body. The expander is designed for a precise fit into the snout and, in one embodiment, includes machinable datums to ensure a tight fit.

In one embodiment, the expander is inserted through the ink reservoir area in the print cartridge body and pushed into the snout, rather than being inserted through the opening at the top of the snout where the printhead substrate is placed.

The press fit forces the snout into an expansion beyond the point to which it would ordinarily expand during the thermal cure cycle. The result is that, during the thermal cure cycle, the snout only changes as a function of the expander's CTE. The expander then remains in the print cartridge throughout its life.

The CTE of the plastic print cartridge body along the short axis of the snout may exceed 100 ppm/° C., and the CTE of the flexible tape is approximately 17 ppm/° C. The expander must narrow this gap to prevent significant warpage of the tape. Hence, the CTE of the expander should, ideally, be low enough to reduce the resulting CTE of the snout to approximately the CTE of the tape, or less than the CTE of the tape. Additional detail regarding the CTE of print cartridge material is found in U.S. Pat. No. 5,537,133, entitled Restraining Element For A Print Cartridge Body To Reduce Thermally Induced Stress, by Jaren Marler et al., assigned to the present assignee and incorporated herein by reference.

The expander can be formed of a molded low CTE material or a low CTE metal.

DETAILED DESCRIPTION

Figure 1:
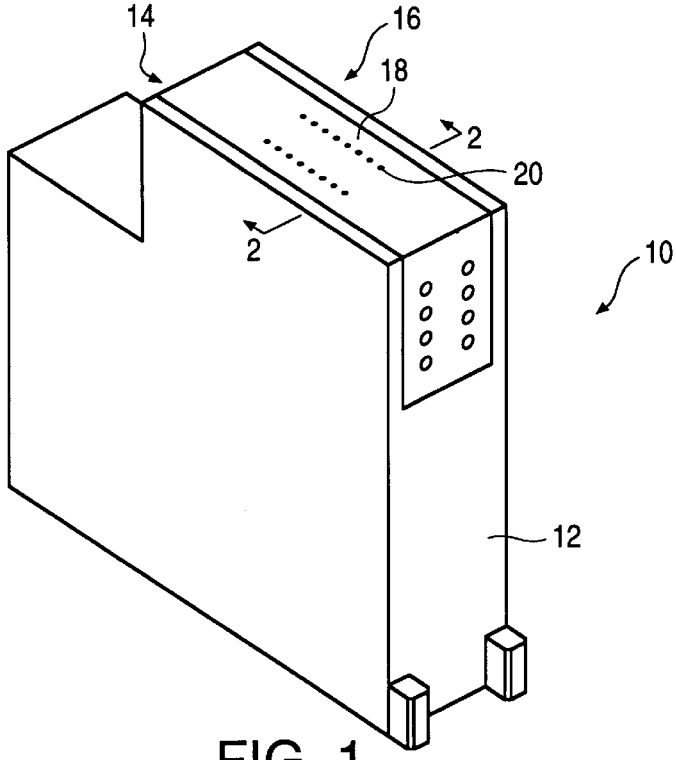
FIG. 1 (PRIOR ART)
FIG. 1 is a perspective view of a print cartridge which may incorporate the present invention.
Figure 2:
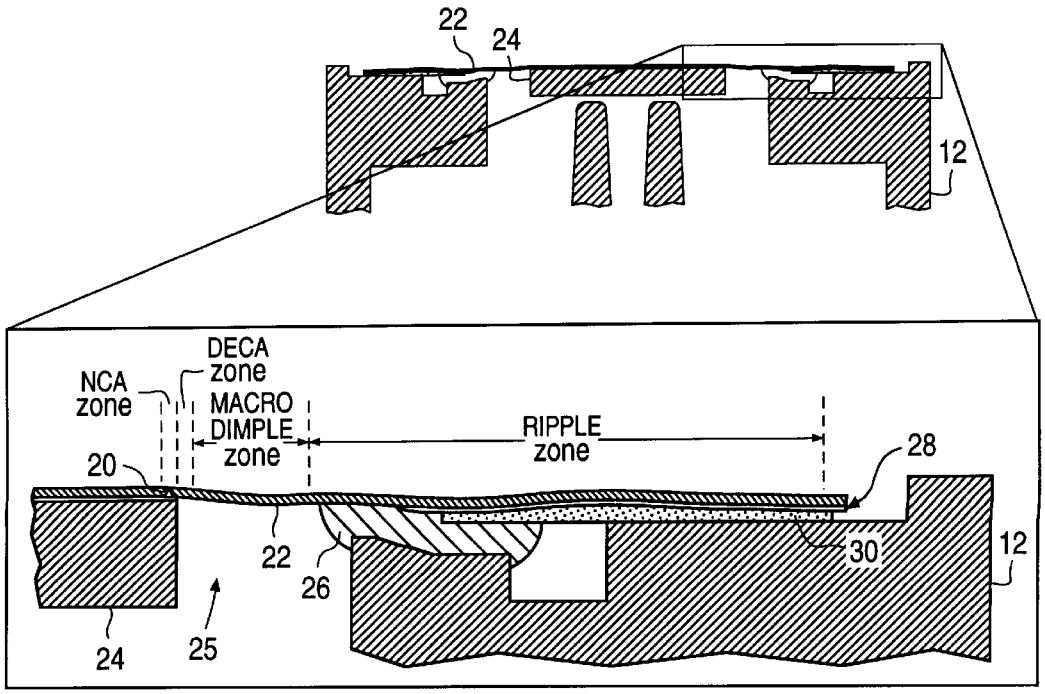
FIG. 2 (PRIOR ART)
FIG. 2 is a cross-section along line 2—2 of FIG. 1 illustrating the warpage of the TAB head assembly in a prior art print cartridge.
Figure 3:
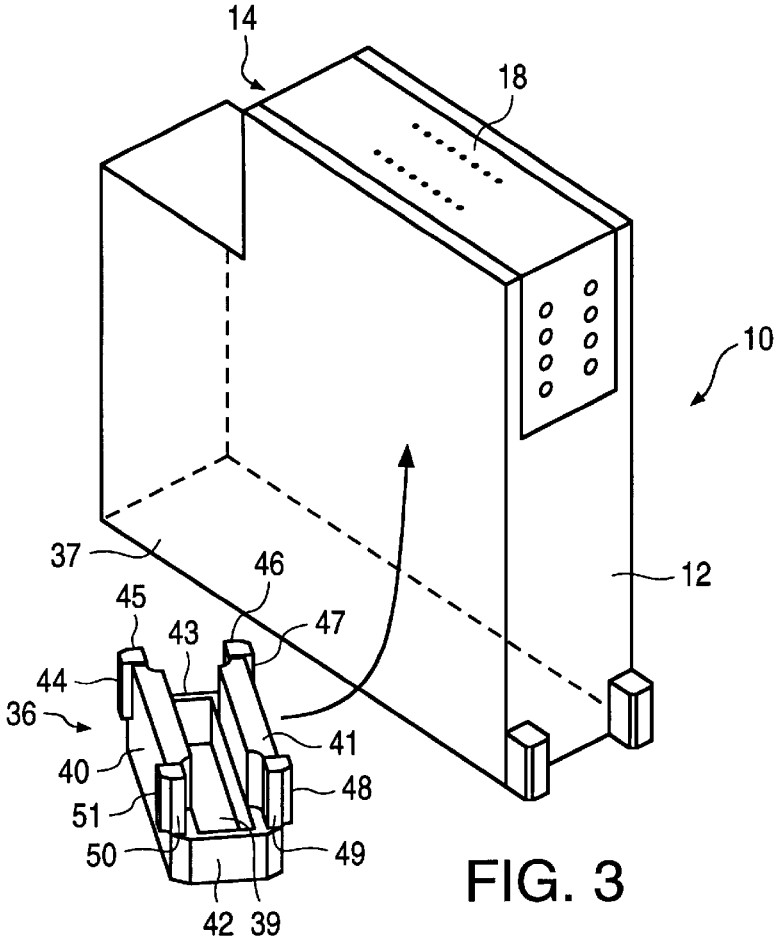
FIG. 3 is a partially transparent view of a print cartridge showing the direction of the insertion of the snout expander.

FIG. 3 is a partially transparent perspective view of a print cartridge 10, which may be the print cartridge shown in FIG. 1 or any other print cartridge having a snout portion. The print cartridge body 12 is an outer shell typically made of a plastic having a snout with a CTE along the snout's short axis of greater than 100 ppm/° C.

Figure 4:
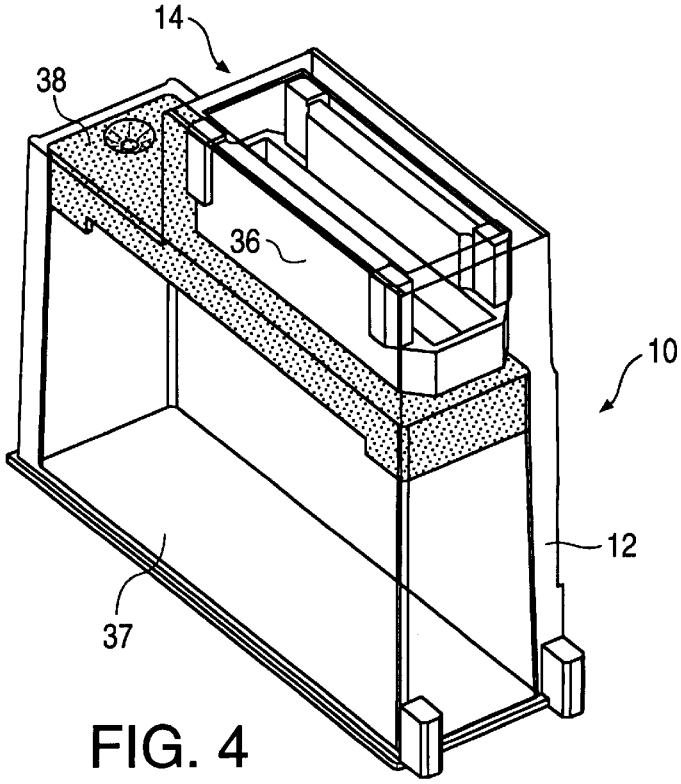
FIG. 4 is a partially transparent view of the print cartridge with the snout expander fully inserted along with a filter assembly.

Prior to the TAB head assembly (or nozzle member 18) being affixed to the top of the snout 14, a low CTE snout expander 36 is inserted through the large opening 37 of the print cartridge and press-fit into the snout 14. FIG. 4 is a partially transparent view of the print cartridge of FIG. 3 showing the snout expander 36 fully inserted. FIG. 4 also shows the porous ink filter 38 inserted after the expander 36.

Referring back to FIG. 3, the expander 36 has a hole 39 for the passage of ink, side walls 40 and 41, end walls 42 and 43, and datums 44–51. The nominal value of the press-fit interference (i.e., the size of the expander beyond the inner dimensions of the snout) is separately controlled in the length and width dimensions using the datums 44–51 over a range from 10 microns to 250 microns. The interference can be controlled by machining (grinding down) the datums.

Figure 5A:
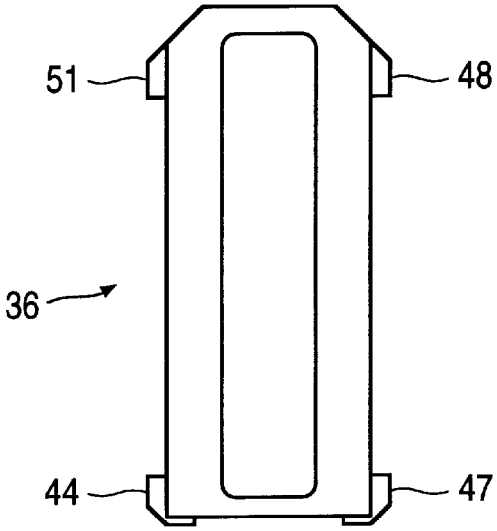
FIGS. 5A and 5B are bottom and side views, respectively, of the expander.
Figure 5B:
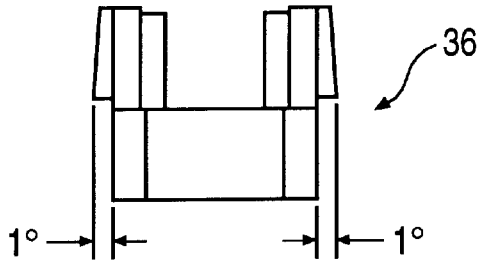

The overall shape and dimensions of the expander 36 are, of course, dependent upon the particular print cartridge for which it is intended. FIG. 5A is a bottom view of expander 36 and FIG. 5B is a side view of expander 36. In one embodiment, the expander 36 has an outer width, including the datums, of about 0.5 inches and a length, including the datums, of about 1.2 inches. The datums may be formed at a slight angle (one degree in FIG. 5B) to match the slope of the snout walls.

The expander 36 may be inserted into the snout 14 during the cartridge fabrication process by a conventional machine which handles and inserts parts using predetermined pressures, as would be understood by those skilled in the art.

By providing a snout expander that contacts the four inner walls of the snout 14, much better control over the CTE of the snout 14 is obtained over using smaller inserts which only fit within the printhead substrate area and are inserted through the top opening of the snout, as described in U.S. Pat. No. 5,537,133. The press-fitting of the snout expander also has advantages over the epoxy-fixed insert described in U.S. Pat. No. 5,537,133, such as ease of assembly and better control of the CTE of the snout.

Although inserting the snout expander 36 through a bottom opening in the print cartridge has been shown in detail, other techniques for inserting the snout expander may be used, depending upon the structure of the print cartridge body. For example, in U.S. Pat. No. 5,648,806, a side wall of the print cartridge body is separate from the outer frame of the print cartridge body. In such a case, the snout expander would be inserted through the side opening in the frame and then into the snout.

In one embodiment, the expander 36 is low CTE metal, such as Invar, a nickel-iron alloy with a CTE of 3 ppm/° C. In another embodiment, expander 36 is formed of a molded low CTE material, such as fiber-filled PPS, LCP, or other suitable engineering material. The fibers can be carbon, glass or other material. The expander 36 preferably has a CTE of less than 50 ppm/° C. to reduce the CTE difference between the snout and the TAB head assembly. Optimally, the expander 36 reduces the snout CTE to a value approximately equal to the CTE of the TAB head assembly or less than the CTE of the TAB head assembly.

If the nozzle member 18 in FIG. 1 is formed of a metal or material other than a plastic film, the expander 36 material would be chosen to best adjust the CTE of the snout to avoid warpage of the nozzle member.

The use of the resulting print cartridge in a printer is identical to that described in U.S. Pat. No. 5,648,806 and need not be repeated herein.

While particular embodiments of the present invention have been shown and described, it would be obvious to those skilled in the art that changes and modifications may be made without departing from this invention in its broader aspects and, therefore, the appended claims are to encompass within their scope all such changes and modifications as fall within the true spirit and scope of this invention.

What is claim is:

1. An apparatus for printing comprising:

a nozzle member having a plurality of ink orifices formed therein, said nozzle member being formed of a first material having a first coefficient of thermal expansion;

a body having a snout portion, said snout portion having a first end and a second end and including a plurality of tapered walls tapering from the second end to the first end, wherein said nozzle member is fixed to the first end of said snout portion, said body being formed of a second material having a second coefficient of thermal expansion substantially higher than the first coefficient of thermal expansion; and an expander press-fit into the second end of said snout portion to prevent substantial relative displacement therebetween, said expander being formed of a third material having a third coefficient of thermal expansion substantially lower than said second coefficient of thermal expansion, wherein said expander limits contraction of the first end of said snout portion such that the coefficient of thermal expansion of the first end of said snout portion is substantially less than said second coefficient of thermal expansion, a resulting coefficient of thermal expansion of the first end of said snout portion with said expander inserted therein being closer to, or less than, said first coefficient of thermal expansion of said nozzle member, said expander thereby substantially reducing deformation of said nozzle member due to thermal expansion of said body.

2. The apparatus of claim 1 wherein said body contains an ink reservoir, said apparatus further comprising a fluid channel communicating between said ink reservoir and said orifices.

3. The apparatus of claim 2 further comprising:

a substrate containing a plurality of ink ejection elements, said substrate having two or more outer edges, said substrate being mounted on a back surface of said nozzle member, each of said ink ejection elements being located proximate to an associated ink orifice, said back surface of said nozzle member extending over two or more of said outer edges of said substrate; and a fluid channel communicating with said ink reservoir to allow ink to flow around side edges of said substrate and into ink ejection chambers, each ink ejection chamber being associated with an orifice in said nozzle member.

4. The apparatus of claim 1 wherein said nozzle member is formed of a flexible polymer material.

5. The apparatus of claim 1 wherein said expander comprises a metal insert.

6. The apparatus of claim 1 wherein said expander comprises a molded material.

7. The apparatus of claim 1 wherein said expander has a central hole which allows ink to flow therethrough and to said orifices.

8. The apparatus of claim 1 wherein said expander is substantially rectangular.

9. The apparatus of claim 1 wherein the third coefficient of thermal expansion of said expander is approximately equal to or less than the first coefficient of thermal expansion of said nozzle member.

10. The apparatus of claim 1 wherein the third coefficient of thermal expansion of said expander is less than 50 ppm/° C.

11. The apparatus of claim 1 further comprising an inkjet printer, said nozzle member ejecting ink droplets to print subject matter on a medium.

12. The apparatus of claim 11 further comprising ink delivered through a hole in said expander and to said orifices.

13. The apparatus of claim 1 wherein said expander includes a plurality of walls and a plurality of datums extending from said walls for controlling a size of said expander.

14. The apparatus of claim 13 wherein sizes of said datums are controlled to obtain a desired fit of said expander in said snout portion.

15. A method of sealing a nozzle member in an inkjet printhead with respect to a snout portion of a body and reducing thermally induced stress between the nozzle member and the snout portion, said nozzle member being formed of a first material having a first coefficient of thermal expansion, said snout portion being formed of a second material having a second coefficient of thermal expansion substantially higher than said first coefficient of thermal expansion, said snout portion having a first end and a second end, the first end being adapted to receive said nozzle member, said method comprising:

press-fitting an expander into said snout portion from the second end, said expander being formed of a third material having a third coefficient of thermal expansion substantially lower than said second coefficient of thermal expansion, wherein said expander limits contraction of the first end of said snout portion to prevent substantial relative deformation therebetween and to cause the coefficient of thermal expansion of the first end of said snout portion to be substantially less than said second coefficient of thermal expansion; and fixing said nozzle member to the first end of said snout portion of said body with an adhesive, wherein a resulting coefficient of thermal expansion of said snout portion, after insertion of said expander, is closer to, or less than, said first coefficient of thermal expansion of said nozzle member, thereby substantially reducing deformation of said nozzle member due to thermal expansion of said body.

16. The method of claim 15 wherein said expander comprises a molded material with a coeffient of thermal expansion less than 50 ppm/° C.

17. The method of claim 15 wherein said expander has a central hole which allows ink to flow therethrough and to said nozzle member.

18. The method of claim 15 wherein the third coefficient of thermal expansion of said expander is approximately equal to or less than the coefficient of thermal expansion of said nozzle member.

19. The method of claim 15 further comprising printing with said printhead by delivering ink through a hole in said expander and expelling said ink through nozzles in said nozzle member.

20. An apparatus for printing comprising:

a body having a snout portion formed of a first material having a first coefficient of thermal expansion, said snout portion having a plurality of tapered walls;

a nozzle member fixed to a first end of said snout portion, said nozzle member being formed of a second material having a plurality of ink orifices formed therein, said second material having a second coefficient of thermal expansion substantially lower than said first coefficient of thermal expansion; and an expander press-fit into a second end of said snout portion, the second end being opposite the first end, said expander including a plurality of walls and a plurality of datums extending from said walls, each of said datums being formed at an angle to match a slope of a respective tapered wall of the snout portion, said expander limiting contraction of the first end of said snout portion to prevent substantial relative displacement therebetween, said expander being formed of a third material having a third coefficient of thermal expansion substantially lower than said second coefficient of thermal expansion, whereby said expander press-fit in said snout portion substantially reduces deformation of said nozzle member due to thermal expansion of said body.

* * * * *